US007992836B2

(12) United States Patent
Schwörer

(10) Patent No.: US 7,992,836 B2
(45) Date of Patent: Aug. 9, 2011

(54) SLAB FORMWORK SYSTEM AND METHOD FOR PREPARATION OF SLAB FORMWORK SYSTEM OF THIS TYPE

(75) Inventor: Artur Schwörer, Senden (DE)

(73) Assignee: PERI GmbH, Weissenhorn (DE)

( * ) Notice: Subject to any disclaimer, the term of this patent is extended or adjusted under 35 U.S.C. 154(b) by 1084 days.

(21) Appl. No.: 11/415,955

(22) Filed: May 1, 2006

(65) Prior Publication Data

US 2007/0209297 A1 Sep. 13, 2007

(30) Foreign Application Priority Data

Mar. 10, 2006 (DE) ..... 20 2006 003 836 U

(51) Int. Cl.
*E04G 11/56* (2006.01)

(52) U.S. Cl. ..... 249/19

(58) Field of Classification Search ..... 249/18, 249/13, 28, 26; 108/55.1, 156, 155, 150, 108/158.13, 157.1; 248/22.52, 228.1, 317; 182/141, 186.6, 182.1–182.5, 222, 186.1, 182/186.3, 186.7, 186.8

See application file for complete search history.

(56) References Cited

U.S. PATENT DOCUMENTS

| | | | | |
|---|---|---|---|---|
| 862,372 | A * | 8/1907 | Alexander | 403/241 |
| 1,907,877 | A * | 5/1933 | Roos | 249/193 |
| 2,454,464 | A * | 11/1948 | Lee | 135/120.4 |
| 3,376,011 | A | 4/1968 | Petchuk | |
| 3,443,351 | A * | 5/1969 | Kumazawa | 52/704 |
| 3,499,398 | A * | 3/1970 | Murray | 108/53.5 |
| 3,647,173 | A * | 3/1972 | Pipala | 249/31 |
| 3,784,151 | A * | 1/1974 | Steele | 249/18 |
| 3,865,250 | A * | 2/1975 | Jay | 211/194 |
| 4,061,092 | A * | 12/1977 | Jacobsen et al. | 108/149 |
| 4,374,580 | A * | 2/1983 | Minor | 248/317 |
| 4,453,655 | A * | 6/1984 | Smilow et al. | 223/87 |
| 4,462,951 | A * | 7/1984 | Martin | 264/334 |
| 4,916,874 | A * | 4/1990 | McCoy et al. | 52/293.2 |
| 5,273,415 | A * | 12/1993 | Jackson | 425/62 |
| 5,531,239 | A * | 7/1996 | Hannah, Jr. | 135/88.1 |
| 5,614,122 | A * | 3/1997 | Schworer | 249/210 |
| 6,871,454 | B2 * | 3/2005 | Coday et al. | 52/126.6 |
| 7,044,065 | B2 * | 5/2006 | Arai et al. | 108/53.1 |
| 7,581,709 | B2 * | 9/2009 | Gillespie et al. | 249/19 |

(Continued)

FOREIGN PATENT DOCUMENTS

DE 10 2005 031 152 A1 1/2007

(Continued)

*Primary Examiner* — Janet M Wilkens
(74) *Attorney, Agent, or Firm* — Kilpatrick Townsend & Stockton LLP

(57) ABSTRACT

A slab formwork system is disclosed having a plurality of formwork elements which have first hook members at their lower side for establishing a hook connection with second hook members provided at upper end sections of vertical supports. The first and second hook members are designed to establish the hook connection, on the one hand, when the formwork elements and the vertical supports extend parallel or obliquely to one another and such that pivoting of a formwork element is possible, on the other hand, while maintaining the hook connection, into such a position in which the formwork element and the vertical supports include an angle of approximately 90°. The formwork element can be coupled, prior to the pivoting, with a railing member extending substantially perpendicular to the formwork element. A method for the preparation of a slab formwork system of this type is also disclosed.

32 Claims, 9 Drawing Sheets

U.S. PATENT DOCUMENTS

| | | | | |
|---|---|---|---|---|
| 2004/0075042 | A1* | 4/2004 | Arozena Bergaretxe | 249/210 |
| 2007/0200049 | A1* | 8/2007 | Coday | 249/18 |
| 2009/0194665 | A1* | 8/2009 | Martin | 249/18 |
| 2009/0212195 | A1* | 8/2009 | Arocena Bergareche et al. | 249/13 |
| 2009/0250589 | A1* | 10/2009 | Schworer | 249/192 |
| 2009/0294627 | A1* | 12/2009 | Schwoerer | 249/18 |

FOREIGN PATENT DOCUMENTS

| | | | |
|---|---|---|---|
| DE | 10 2005 031 153 | A1 | 1/2007 |
| EP | 1251222 | A2 | 10/2002 |
| WO | WO 2006/089975 | A2 | 8/2006 |

* cited by examiner

SLAB FORMWORK SYSTEM AND METHOD FOR PREPARATION OF SLAB FORMWORK SYSTEM OF THIS TYPE

CROSS-REFERENCE TO RELATED APPLICATIONS

This application claims the benefit of German Utility Model No. DE 20 2006 003 836.1, filed on Mar. 10, 2006, the disclosure of which is incorporated herein by reference.

FIELD OF THE INVENTION

The present invention relates to a slab formwork system having a plurality of formwork elements which have first hook members at their lower side for the establishing of a hook connection with second hook members provided at upper end sections of vertical supports, with the first and second hook members being designed such that the hook connection can be established, on the one hand, when the formwork elements and the vertical supports extend parallel or obliquely to one another and such that a pivoting of a formwork element is made possible, on the other hand, while maintaining the hook connection, into such a position in which the formwork element and the vertical supports include an angle of approximately 90°. The invention furthermore relates to a method for the preparation of a slab formwork system of this type.

BACKGROUND OF THE INVENTION

Slab formwork systems of the named type are used in practice in a number of embodiments in the erection of buildings to provide a reception region for liquid concrete which forms the respectively desired slab structure after its hardening.

It is often necessary during the preparation of slab formwork systems, and in particular also in work subsequent thereto, that an erector moves on the surface of already erected formwork elements so that a risk of falling is generally present in this process. To reduce this risk, it is known to couple the formwork elements with railing members after their erection. However, a risk of falling and of accident is also present in this case at least before and during the attachment of railing members of this type.

SUMMARY OF THE INVENTION

An object of the invention consists of providing a slab formwork system and a method for the preparation of a slab formwork system of this type in which the risk of accident is reduced to a minimum both during the erection and in work subsequent thereto, with the erection in particular being able to be carried out economically in a simple manner.

This object is satisfied in accordance with the invention by a slab formwork system in accordance with the features of the embodiments disclosed herein and in particular in that the formwork element can be coupled prior to the pivoting with a railing member extending substantially perpendicular to the formwork element.

A method in accordance with the invention for the preparation of a slab formwork system is accordingly characterized by the features of the embodiments disclosed herein.

The invention is thus based on the surprisingly simple, but nevertheless very effective, idea of already coupling the formwork elements to the respectively required railing member or members before their final erection so that the railing members are already located in their final destination position when the erection of the respective formwork element is completed. In this process, the invention utilizes the recognition that, after the hooking together of the first and second hook members, a large portion of the weight of the formwork elements is already absorbed by vertical supports so that it is not disturbing with respect to the weight to be handled by the erector if a formwork element additionally also bears at least one railing member. The coupling is preferably established between the formwork element and the railing member after the first and second hook members have been hooked together with one another. Alternatively, the connection between the formwork element and the railing member can, however, also already be provided before the establishing of the named hook connection.

After the establishing of the hook connection between the first and second hook members and the coupling of the formwork element with the railing member, the formwork element can be pivoted upwardly into its final position together with the coupled railing member such that the formwork element and the vertical supports then include an angle of approximately 90°. In this process, the pivoting takes place around an axis which extends through the first and second hook members coupled to one another, with a formwork element preferably being hung at two vertical supports such that two first hook members are in engagement with two second hook members on the named pivot procedure.

The formwork elements used in accordance with the invention preferably consist of a plurality of longitudinal members extending parallel to one another and at least one cross member extending transversely thereto, with the first hook members being provided at the cross member or being formed by the cross member. In the erected position of the formwork elements, the cross members accordingly extend beneath the longitudinal members, with the cross members and the longitudinal members preferably being rigidly connected to one another to form a grid member.

It is particularly advantageous for third hook members, which are coupled or can be coupled to a tensioning member, in particular to a chain, to be able to be hung into the cross members. In this manner, the cross members can be anchored downwardly after the first and second hook members have been hooked together with one another, whereby a lifting of a formwork element from the upper end sections of the vertical supports can be effectively prevented during the pivoting of the formwork elements. This is in particular achieved when the hook connection between the third hook members and the cross members is formed such that it is maintained or is effective when the formwork element and the vertical supports extend parallel or obliquely to one another, when the formwork element and the vertical supports include an angle of approximately 90° and also when the formwork element is pivoted between the aforesaid positions.

The third hook members preferably have a force transmitting region whose cross-section is at least substantially circular or partly circular. It can be ensured by the interaction of a force transmission region of this type with a cross beam that the formwork element or the cross member can be pivoted around an axis which substantially extends through the center of the circular or partly circular cross-section of the force transmission region without the position of the third hook member substantially changing. In this manner, it can be achieved that the tensioning member coupled to the third hook member is located in a sufficiently tensioned state during the total pivot procedure. In this process, the center of the cross-section of the force transmission region preferably has a spacing from the pivot axis of the formwork element of less than 2 cm. A sufficiently tensioned state of the tensioning member during the pivot procedure is in particular achieved when the spacing of the center of the cross-section of the force transmission region of the third hook member from the base-side fastening point of the tensioning member coupled to the third hook member only varies by a maximum of 10 mm during the pivoting of the formwork element.

It is of advantage for the cross member of the formwork elements to have an at least regionally C-shaped cross-section with two limbs extending away from a base section. One of the limbs in this case forms a support surface for placing on an upper end section of a vertical support, with this upper end section having fixing elements which each engage into a respective recess of the support surface. The limb forming the support surface then simultaneously forms a section of the first hook members in accordance with the invention. A forming of such a cross member with a C-shaped cross-section in this manner advantageously has the result that the third hook members can be hooked to the cross member along its longitudinal direction in almost any desired position thereof so that different erection conditions can be taken into account here.

It is particularly preferred for the cross member or for the formwork element to be able to be coupled to the vertical support or supports in two directions offset by 90° with respect to one another. An embodiment of this type is described in the German patent application DE 10 2005 031 152.0 of the applicant. All the features disclosed in this application can also be realized within the framework of the present invention.

When coupling the third hook members to the cross members C-shaped in cross-section, the limb of the cross members forming the support surface can be engaged behind by the third hook members.

The railing member used in accordance with the invention preferably consists of at least one cross-spar and two supports extending perpendicular thereto which have a respective fastening section at each of their ends remote from the cross-spar for the coupling to a respective longitudinal member of a formwork element. As a rule, a coupling of the supports to the two outermost longitudinal members of a formwork element takes place in this process.

A particularly good force transmission between the supports of a railing member and the longitudinal members can be realized in that the fastening sections of the support each engage around a longitudinal member at all sides, with the connection present between the fastening sections and the longitudinal members preferably being made in a releasable manner.

The two fastening sections of a railing member can be connected to one another by a latching bar which, in its latched position coupled to a formwork element, supports those longitudinal members which are arranged between the longitudinal members coupled to the fastening sections. In this manner, the latching bar additionally satisfies the function of a cross member arranged beneath the longitudinal members, which is in particular of advantage when a formwork element is only fitted with one cross member, since in this case the latching bar can provide additional stability.

It is finally also advantageous for standard formwork elements to have two cross members provided in the end regions of the longitudinal members remote from one another, whereas transverse compensation formwork elements have one or two cross members arranged inwardly offset in comparison with the standard formwork elements. In this case, formwork elements are therefore made available in at least two embodiments differing from one another. If it is then, for example, necessary to provide individual dimensions outside the grid dimensions of the standard formwork elements in a direction extending perpendicular to the longitudinal members, transverse compensation formwork elements are also additionally used. These transverse compensation formwork elements differ from the standard formwork elements in that their cross beams are arranged offset further inwardly. It thereby becomes possible to mesh a standard formwork element and a transverse compensation formwork element with one another such that an outer longitudinal member or also a plurality of outer longitudinal members of a transverse compensation formwork element each come to rest between two adjacent longitudinal members of a standard formwork element. In this manner, individual dimensions can be realized in a transverse direction extending perpendicular to the longitudinal members in that the respectively desired number of longitudinal members of a transverse compensation formwork element is positioned in each case between two adjacent longitudinal members of a standard formwork element.

An arrangement of this type is described in the German patent application DE 10 2005 031 153.9 of the applicant. All the features named in this application can also be realized within the framework of the present invention.

Further preferred embodiments of the slab formwork system in accordance with the invention and of the method in accordance with the invention for the preparation of a slab formwork system of this type are described herein.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
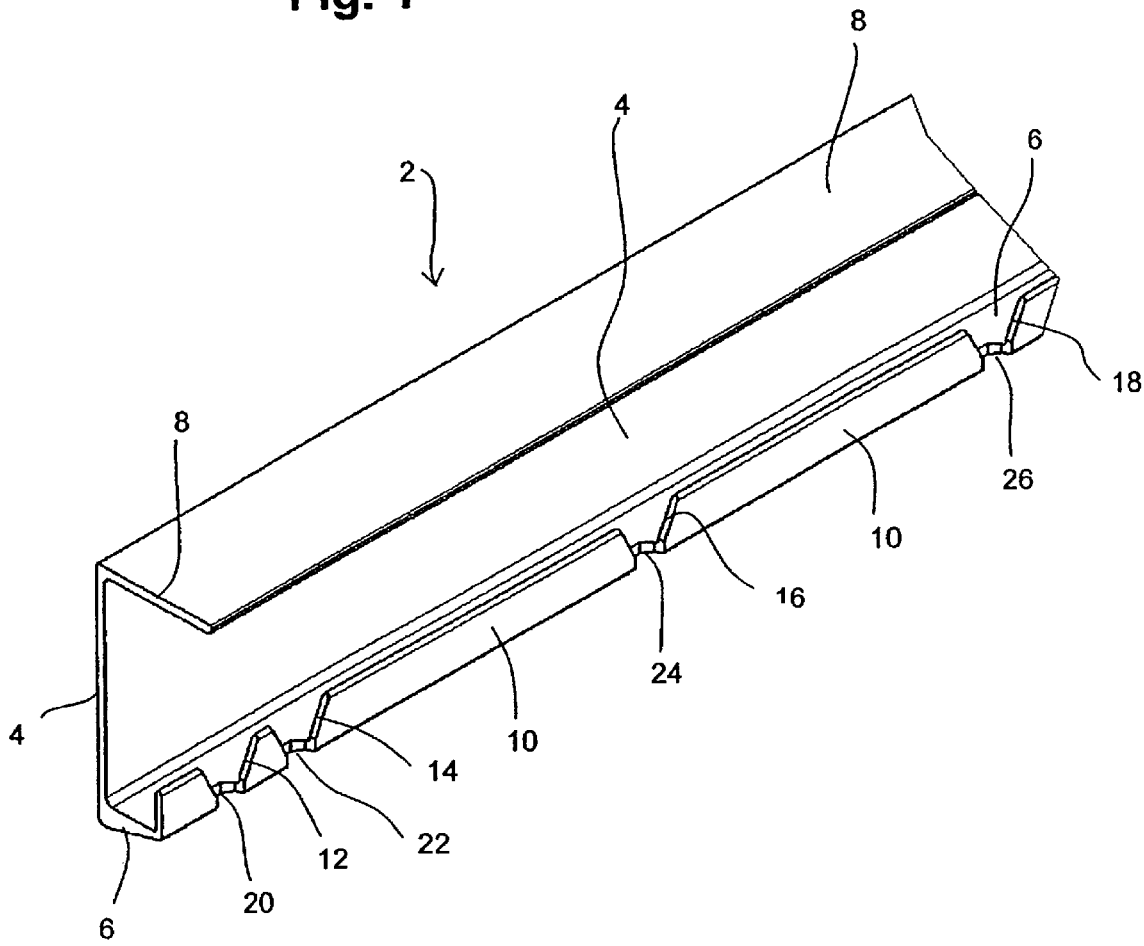
FIG. 1 is a three-dimensional view of an end section of a cross beam being used within the framework of the invention and being able to be coupled to the upper end section of a vertical support.

The cross member 2 shown in FIG. 1 is made as an open elongate section element which has a C-shaped section with two limbs extending away from a base section 4, with the lower limb being designed as a support surface 6 for placing on a head of a vertical support forming the upper end section of a vertical support. The upper limb forms a contact surface 8 for the lower sides of longitudinal members which, for example, extend perpendicular to the cross member 2 so that the named longitudinal members form a formwork or grid element together with the cross member 2, and optionally further cross members, to which a formwork skin can be applied. Alternatively, the contact surface 8 can also serve directly as a contact surface for a formwork skin.

The lower side of the support surface 6 does not extend parallel to the contact surface 8, but rather obliquely upwardly in the direction of the contact surface 8. It results in this manner that the thickness of the support surface 6 becomes smaller as the spacing from the base section 4 increases, since the upper side of the support surface 6 facing the contact surface 8 extends, unlike its lower side, parallel to the contact surface 8. The advantages of this design will be explained in the following in connection with FIGS. 4*a-c*.

An upwardly angled lug 10 is shaped on the end of the support surface 6 remote from the base section 4 and extends parallel to the base section 4 in the direction of the contact surface 8. Alternatively to the named angling, a round transition could also be formed between the support surface 6 and the lug 10 so that e.g. substantially the shape of a quarter-circle is adopted in the cross-section between the support surface 6 and the lug 10. The lug 10 in the embodiment shown is provided with four V-shaped cut-outs 12, 14, 16, 18 which are spaced apart from one another in the longitudinal direction of the cross member 2, with the width of these cut-outs 12 to 18 each reducing as the spacing from the contact surface increases. The cut-outs 12 to 18 extend over the total height of the lug 10 and merge in their lower end region into recesses 20, 22, 24, 26 of the support surface 6. The width of the recesses 20 to 26 in this process corresponds approximately to the width of the V-shaped cut-outs 12 to 18 in their end region facing the recesses 20 to 26. The recesses 20 to 26 extend into the support surface 6 by less than half the length of the support surface 6.

The cut-outs 12 to 18 can form a "threading aid" for the introduction of fixing elements into the recesses 20 to 26 by the named arrangement of the cut-outs 12 to 18 and of the recesses 20 to 26, with this threading aid in particular being effective when the cross member 2 is pivoted upwardly by 90° into its position shown in FIG. 1 after the guiding up to a fixing element. This pivot movement is promoted by the explained oblique orientation of the lower side of the support surface 6.

Only an end region of the cross member 2 is shown in FIG. 1. The other end region (not shown) of the cross member 2 is made analogously to the end region shown so that the cross member 2 has four respective cut-outs 12 to 18 and four recesses 20 to 26 in each of its two end regions. The cut-outs 12 and 14 in this process are provided in the outermost end region of the cross member 2 only slightly spaced apart from one another, whereas the spacing between the cut-outs 14 and 16 and the spacing between the cut-outs 16 and 18 is dimensioned larger and in each case corresponds to the spacing from adjacent fixing elements of a head of a vertical support.

Figure 2:
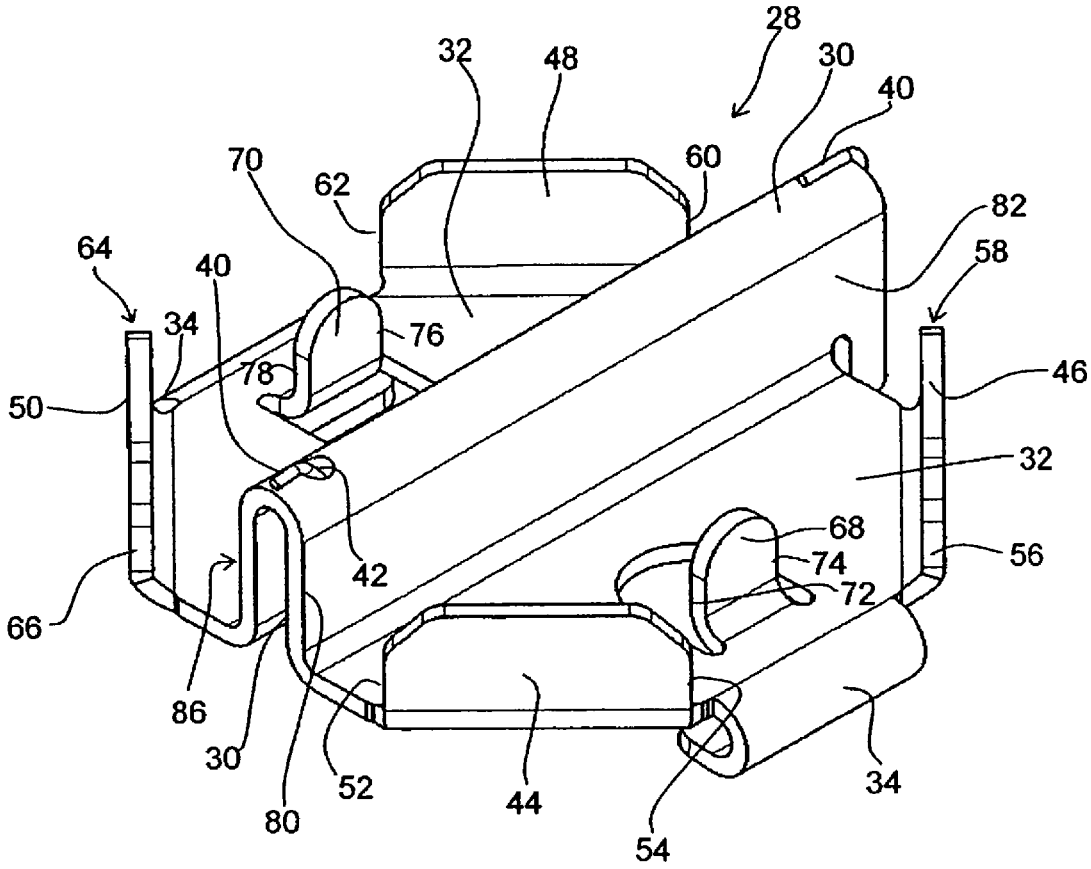
FIG. 2 is a three-dimensional view of an upper end section of a vertical support, which can be coupled to a cross member in accordance with FIG. 1, obliquely from above.

FIG. 2 shows, in a three-dimensional view, a head 28 which can be coupled to a vertical support (not shown) and then accordingly forms the upper end section of a vertical support. The head 28 in this process is produced from an originally substantially rectangular steel plate which is curved such that a U-shaped curved section 30 is formed in its central region which extends upwardly over the total width of the head 28. The U-shaped section 30 in this process divides the base surface of the head 28 formed as a support plane 32 into two halves of equal size between one another. With cross members 2 erected at the head 28, the named support plane 32 absorbs the vertical forces to be transmitted from the cross members 2 onto a vertical support since the support surface 6 of a cross member 2 is ultimately supported on the support plane 32 of the head 28 which will be explained in the following.

Spaced apart perpendicularly from the U-shaped section 30, the support plane 32 has a respective coupling lug 34 which is curved downwardly in U-shape at each of its two end regions remote from one another so that a receiving plane for a head plate (not shown) of a vertical support is defined between the coupling lugs 34 facing one another which extends parallel to the support plane 32. A head plate of this type can be pushed in the longitudinal direction of the U-shaped section 30 into the coupling lugs 34 until it abuts two abutment members 36 which are made integrally with the U-shaped section and extend downwardly, starting from this, into the named receiving plane for the head plate of the vertical support.

A spring member is fastened in the hollow space surrounded by the U-shaped section 30. The end sections 40 of the spring member are curved in the region of an opening 42 of the U-shaped section 30 and in the region of an end-face end of the U-shaped section 30 such that the spring member is captively held at the head 28. The spring member 38 is shaped in this process such that a middle section of the same extends downwardly at least up to and into the receiving plane provided for the head plate of a vertical support and formed between the coupling lugs 34 such that the named section of the spring member 38 can snap into an end-face hollow space of a vertical support or of a head plate of a vertical support, whereby the head 28 can be fixed in a defined position with respect to a vertical support.

The four corner regions of the support plane 32 are each curved upwardly perpendicular to the support plane 32 so that they form a total of four fixing lugs 44, 46, 48, 50 which each extend at an angle of 45° to the longitudinal direction of the U-shaped section 30. The width of the fixing lugs 44 to 50 amounts to somewhat more than twice their height, with the two corner regions of the fixing lugs 44 to 50 remote from the support plane 32 in each case being chamfered. Each of the two perpendicular edges 52, 54; 56, 58; 60, 62; 64, 66 of the fixing lugs 44 to 50 in this process forms a respective fixing element which is suitable in the sense of the invention for an engagement into a recess 20 to 26 of a cross member 2. On a coupling of a cross member 2 via one of the fixing lugs 44 to 50, in each case always only one of the two fixing elements 52 to 66 of a fixing lug 44 to 50 becomes effective. The provision of two fixing elements 52 to 66 per fixing lug 44 to 50 makes it possible selectively to couple a cross member 2 to a fixing lug 44 to 50 in two directions offset to one another by 90° and extending parallel to the support plane 32.

An abutment lug 68, 70 curves upwardly out of each of the two halves of the support plane 32, with each of the two end-face edges extending perpendicular to the support plane 32 of the abutment lugs 68, 70 each forming an abutment surface 72, 74, 76, 78 for the rear side of the base section 4 of a cross member 2.

Four further abutment surfaces 80, 82, 84, 86 are formed by regions of the U-shaped section 30 extending perpendicular to the support plane 32. These abutment surfaces 80 to 86 are also each suitable to cooperate with the rear side of the base section 4 of a cross beam 2.

Specifically, a cross member 2 can be fixed between the following pairs of respective mutually oppositely disposed fixing elements 52 to 66 and abutment surfaces 72 to 86: 52, 80; 54, 72; 56, 74; 58, 82; 60, 84; 62, 76; 64, 78; 66, 86.

Figure 3:
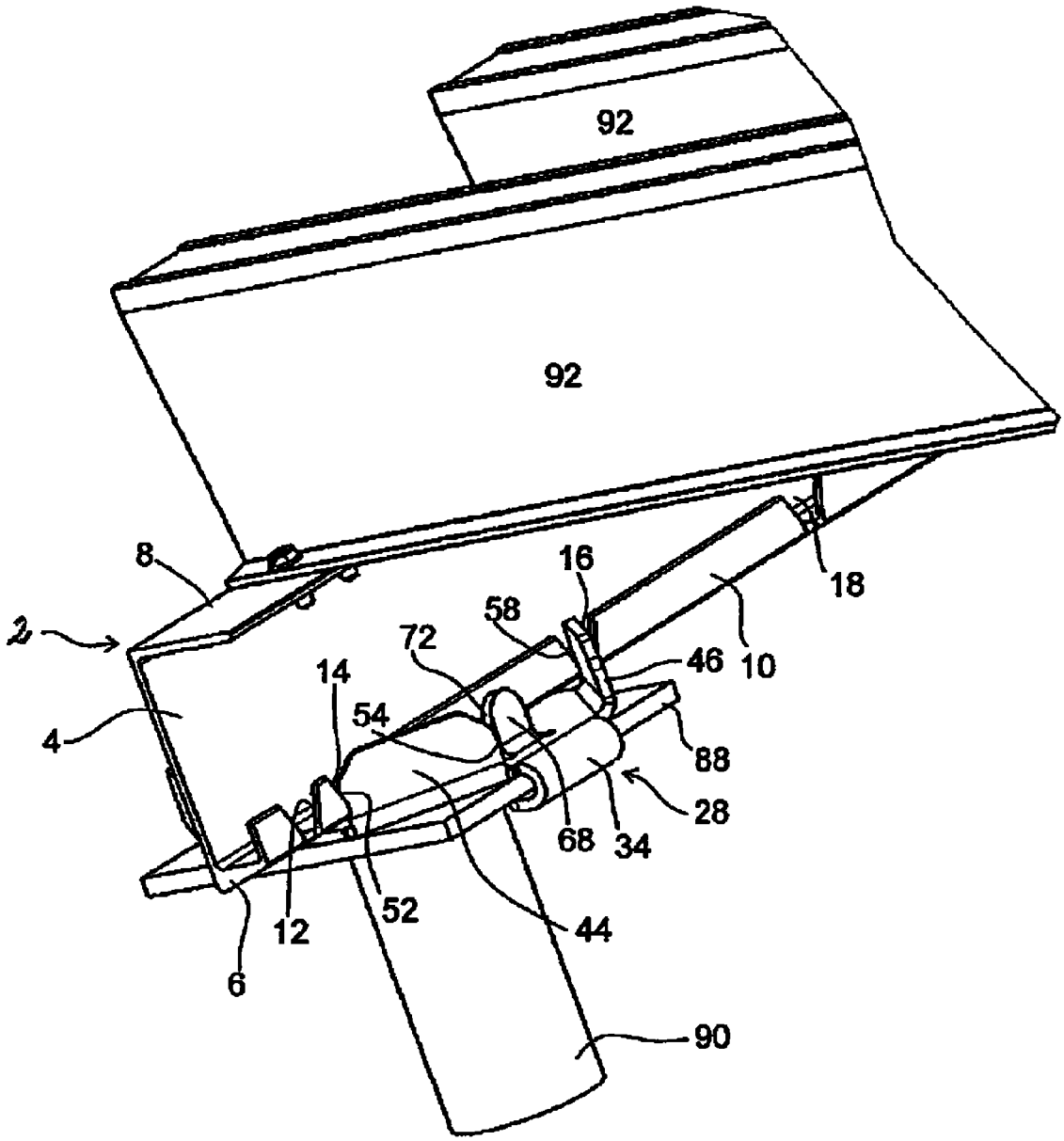
FIG. 3 is a three-dimensional view of a cross member in accordance with FIG. 1, which is coupled to an upper end section of a vertical support in accordance with FIG. 2, obliquely from above.

FIG. 3 shows a head plate 88 of a vertical support 90 which is inserted into coupling lugs 34 of a head 28. A cross member 2 in accordance with FIG. 1 is coupled to the head 28 and longitudinal members 92 are fastened to its contact surface 8 and extend perpendicular to the cross member 2.

The cross member 2 is coupled to the head 28 such that the fixing element 52 extends into the cut-out 14 and the recess 22 (FIG. 1). At the same time, the fixing element 58 extends into the cut-out 16 and the recess 24 (FIG. 1). The base section 4 of the cross member 2 in this process is supported at its rear side at the abutment surfaces 80 and 82 (FIG. 2) so that ultimately these abutment surfaces 80, 82 effectively prevent—together with the fixing elements 52, 58—the cross member 2 from being able to move perpendicular to its base section 4. The engagement between the fixing elements 52, 58 and the recesses 22, 24 simultaneously ensures that no movement can take place relative to the head 28 in the longitudinal direction of the cross member 2.

Alternatively, the cross member 2 could also be coupled to the head 28 in a position which is offset in the longitudinal direction of the cross member 2 and in which the fixing elements 52, 58 would engage into the cut-outs 16, 18 or into the recesses 24, 26 corresponding therewith.

It would furthermore also be possible only to couple the cross member 2 with the head 28 in that the fixing element 58 is introduced into one of the two cut-outs 12, 14 and the recesses 20, 22 corresponding therewith. In these cases, the cross member 2 would then no longer extend over the whole support plane 32 of the head 28 as in accordance with FIG. 3. It would rather only extend over less than half the width of the support plane 32 so that, for example, a further cross member 2 could be coupled to the head 28 via the fixing element 52 so that both cross members 2 would extend aligned with one another in the longitudinal direction.

Finally, a cross member 2 could also be coupled to the head 28 via its cut-outs 12, 14 or recesses 20, 22 such that it extends perpendicular to its alignment shown in FIG. 3. In this case, the fixing element 54 would then engage into one of the recesses 20, 22, with the rear side of the base section 4 of the support being supported at the abutment surface 72 of the abutment lug 68.

It is in particular also possible to couple two or three cross members 2 to the head 28, with each of the cross members 2 then being able to be fixed between one of the pairs of fixing elements 52 to 66 and abutment surfaces 72 to 86 already named above. The individual cross members 2 can extend parallel or also perpendicular to one another.

Figure 4A:
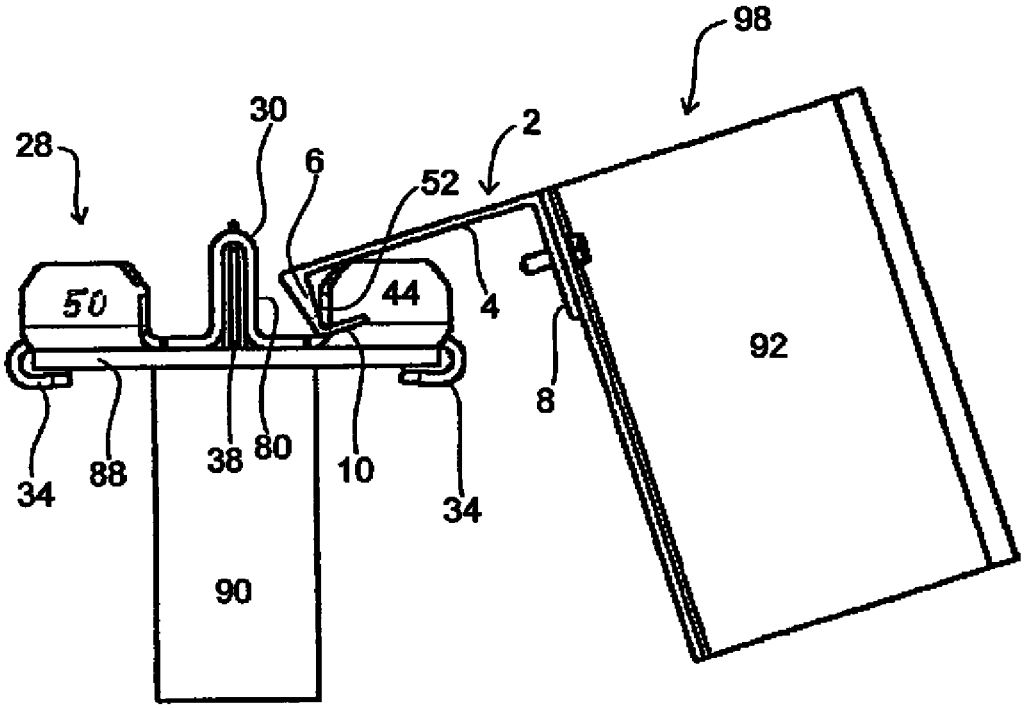
FIGS. 4*a-c* are, in each case, a side view of different method steps on the coupling of a cross member in accordance with FIG. 1 with an upper end section in accordance with FIG. 2.
Figure 4B:
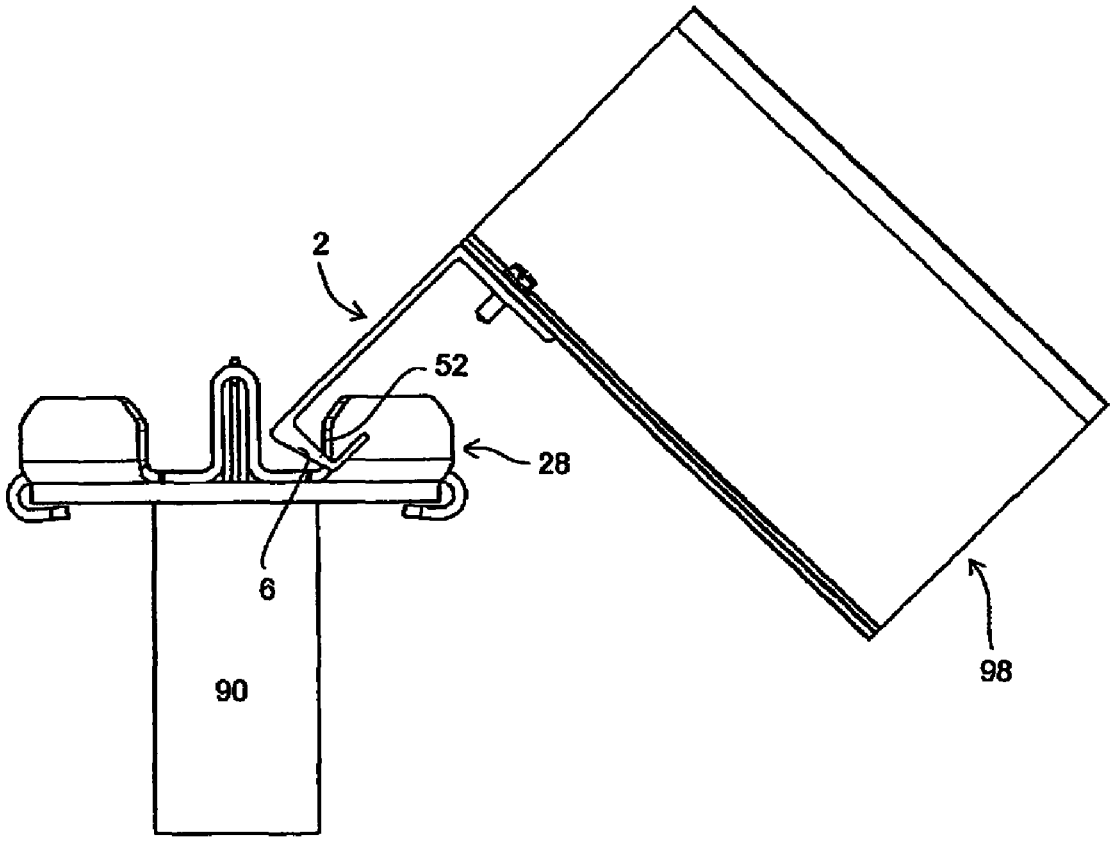
Figure 4C:
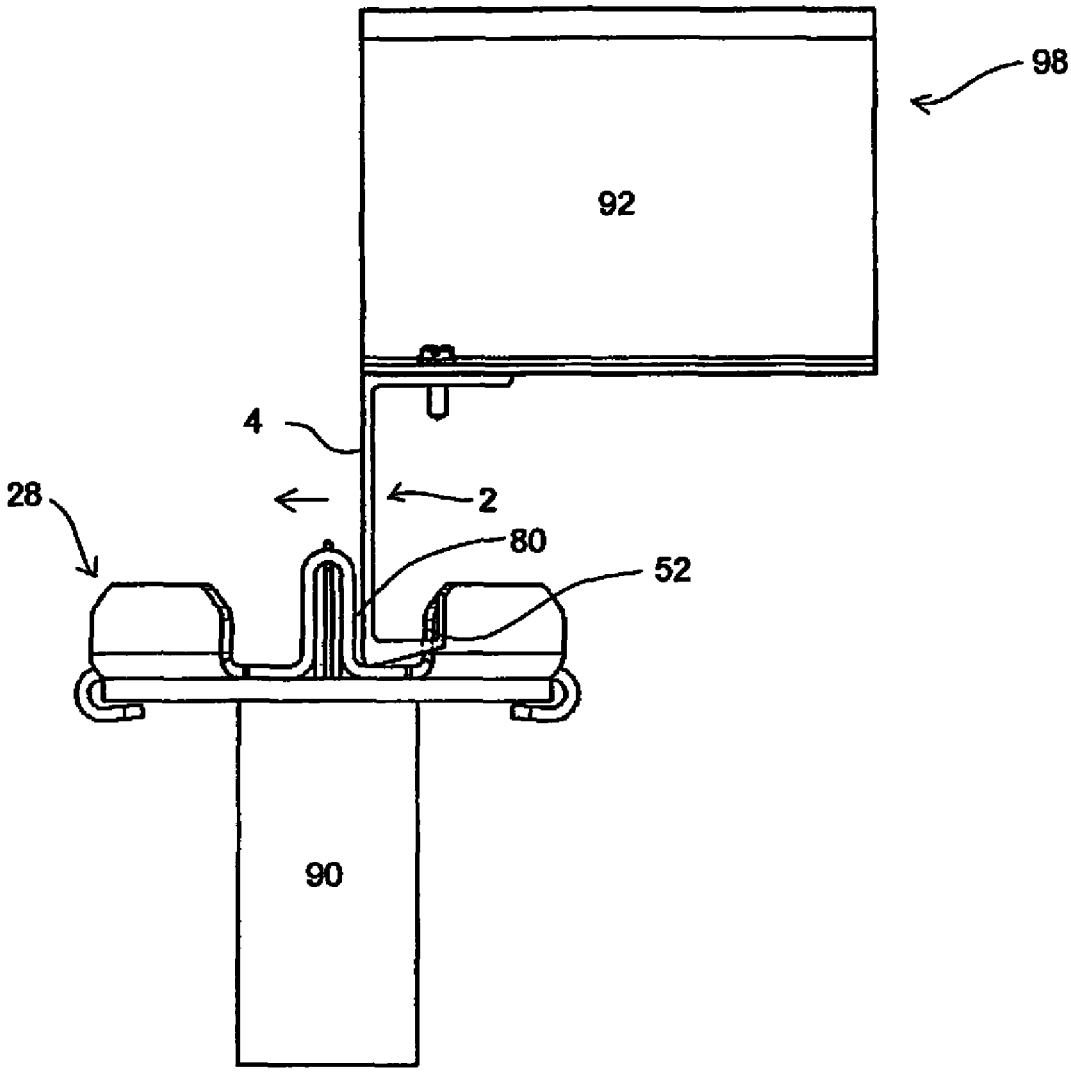

FIGS. 4*a* to *c* show how a coupling can be established between the cross member 2 and the head 28 as is shown in FIG. 3.

First, a formwork element 98 comprising cross members 2 and longitudinal members 92 is aligned relative to a vertical support 90 such that the longitudinal members 92 extend either substantially parallel to the vertical support 90 or—as shown in FIG. 4*a*—somewhat obliquely to this alignment. In this alignment, a formwork element 98 can be taken up easily by an erector and raised such that the cross member 2 is ultimately located above a head 28 of the vertical support 90. Starting from this raised position, the formwork element 98 is then aligned and lowered by the erector such that the fixing elements 52, 58 are introduced into the V-shaped cut-outs 14, 16 of the lug 10. This introduction is facilitated by the V shape of the cut-outs 14, 16. In this manner, a hook connection is therefore already established between the head 28 and the cross member 2 in which the weight of the formwork element 98 can be led to a greater part via the support plane 32 into the vertical support 90 such that the person carrying out the erection only has to hold a low part of the weight of the formwork element 98. In the sense of the invention, the support surface 6 together with the lug 10 forms the first hook members in the named hook connection and the fixing elements 52, 58 formed at the fixing lugs 44, 46 form the second hook members.

Starting from the hook connection in accordance with FIG. 4*a*, the formwork element 98 in accordance with FIG. 4*b* is now pivoted upwardly in the arrow direction around a pivot axis extending parallel to the longitudinal axis of the cross member 2, with the fixing elements 52, 58—guided by the V-shaped cut-outs 14, 16—automatically being moved into the recesses 22, 24 of the support surface 6 of the cross member 2 during this pivot movement. The named pivot movement is continued for so long until the position in accordance with FIG. 4*c* is reached in which the formwork element 98 and its longitudinal member 92 extend perpendicular to the vertical support 90 in the horizontal direction. It can be seen particularly illustratively from FIG. 4*c* that the abutment surfaces 80, 82 in this completely erected position effectively prevent the cross member 2 from moving in the arrow direction perpendicular to the base section 4 of the cross member 2 such that the fixing elements 52, 58 move out of engagement with the recesses 22, 24.

If, within the framework of the dismantling of the formwork element 98, work is carried out in the reverse order, the slope formed at the lower side of the support surface 6 and which includes an angle of approximately 75° with the base section 4 comes advantageously into effect. It namely becomes possible on the basis of this slope to pivot the formwork element 98 away, starting from the position in accordance with FIG. 4*c*, against the arrow direction of FIG. 4*b*, without a clamping effect occurring between the upper side of the formwork element 98, a formwork skin lying thereon and an already prepared concrete slab. The slope rather ensures that all parts of the formwork element 98 move downwardly on the pivoting away such that a problem-free removal from the formwork becomes possible.

In accordance with the invention, a railing member is coupled to the formwork element comprising cross members 2 and longitudinal members 92 before the pivot procedure described in connection with FIG. 4*b*. This is illustrated in FIG. 5.

Figure 5:
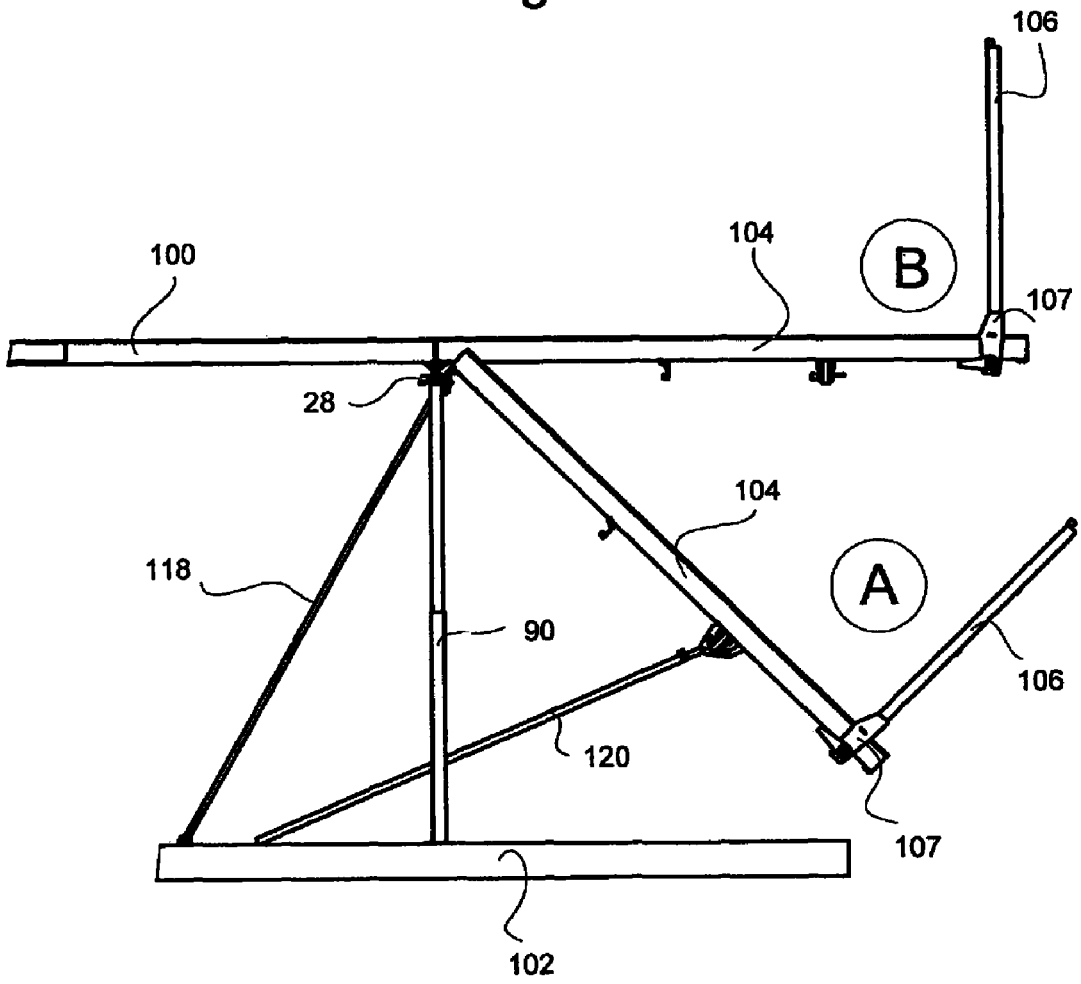
FIG. 5 is a side view of a region of a slab formwork system in accordance with the invention in two different erection phases.

An already completely erected formwork element 100 is supported at the base 102 at its one end region via two vertical supports 90 arranged sequentially perpendicular to the plane of the drawing of FIG. 5. The upper end section of the vertical support 90 is made as a head 28 in accordance with FIG. 2. A further formwork element 104 is now hung into this head 28 in the already described manner such that the first hook elements 6, 10 of the formwork element 104 move into engagement with the second hook members 44, 46 of the head 28. On this hooking together of the formwork element 104 and the head 28, a railing member 106 can already be coupled to the formwork element 4. In accordance with FIG. 5, the railing member 106 is located in the end region of the formwork element 104 remote from the head 28. The railing member 106 and the formwork element 104 extend perpendicular to one another in this process. At its lower end, the railing member 106 has two fastening sections 107 which engage around the two outer longitudinal members of the formwork element 104 at all sides.

Alternatively, it is also possible only to couple the formwork element 104 with the railing member 106 after the hook connection has been established between the formwork element 104 and the head 28.

Upon establishing the named hook connection, the formwork element 104 extends obliquely to the vertical support 90 analogously to FIG. 4*a*. This position of the formwork element 104 is marked by the letter A in FIG. 5.

Figure 6:
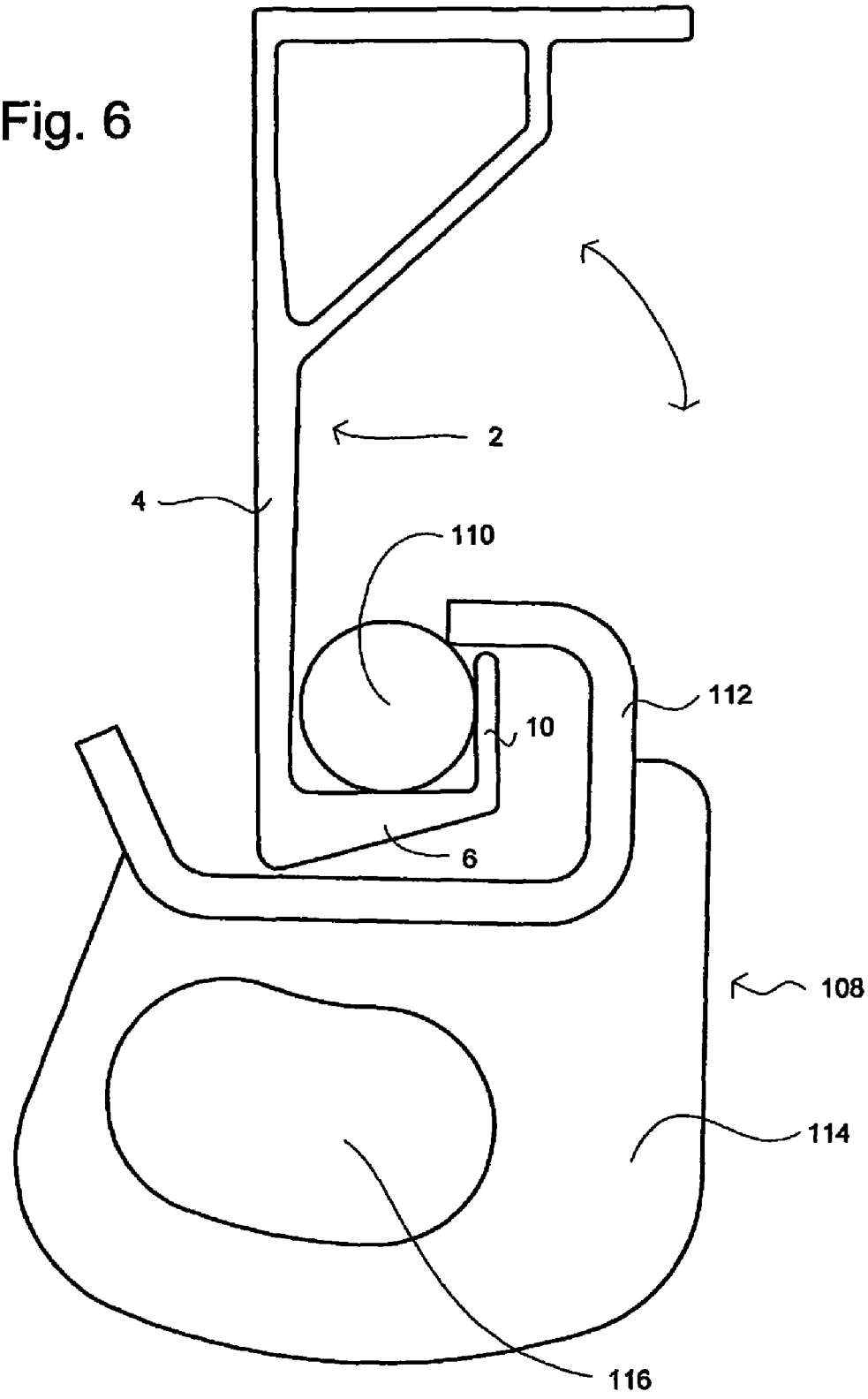
FIG. 6 is a section through a cross beam being used in a slab formwork system in accordance with FIG. 5 with a third hook member coupled thereto.

Directly after the establishing of the hook connection between the formwork element 104 and the head 28, that is, even before an upward pivoting of the formwork element 104, the third hook member 108 shown in FIG. 6 is hooked to that cross member 2 which is hung into the head 28 in accordance with FIG. 5. The third hook member 108 has a force transmission region 110 which is circular in cross-section and which almost completely fills the space present between the lug 10, the support surface 6 and the base section 4 of the cross member 2. The force transmission region 110 is then coupled via a U-shaped member 112 with a lug region 114 in which an eyelet 116 is formed into which a tensioning chain 118 (FIG. 5) can be hung. The free end of the tensioning chain 118 is anchored to the base 102 such that it substantially extends perpendicular to the formwork element 104 located at position A.

FIG. 6 illustrates that a pivoting of the cross member 2 in the arrow direction around the center of the force transmission region 110 is possible, without the third hook member 108 substantially being moved, due to the design of the force transmission region 110 substantially circular in cross-section. In this respect, a tensioning of the tensioning chain 118 is also always maintained on a pivoting of the cross member 2.

After it has been ensured by the tensioning chain 118 that the formwork element 104 can no longer release from the head 28, the formwork element 104 is pivoted upwardly by means of a lifting rod 120 (FIG. 5) around the pivot axis extending perpendicular to the plane of the drawing of FIG. 6 through the center of the force transmission region 110 until it is in position B. In this pivot procedure, the railing member 106 is moved upwardly together with the formwork element 104 until the formwork element 104 extends horizontally and the railing member 106 extends vertically.

Subsequently, the formwork element 104 can be supported at the base side at its end remote from the tensioning chain 118 by means of further vertical supports (not shown).

It is thus ensured in accordance with the invention that, directly after the end of the erection of one formwork element 104, a railing member 106 is also already erected which thus contributes to reducing a risk of falling from the earliest possible time.

Figure 7:
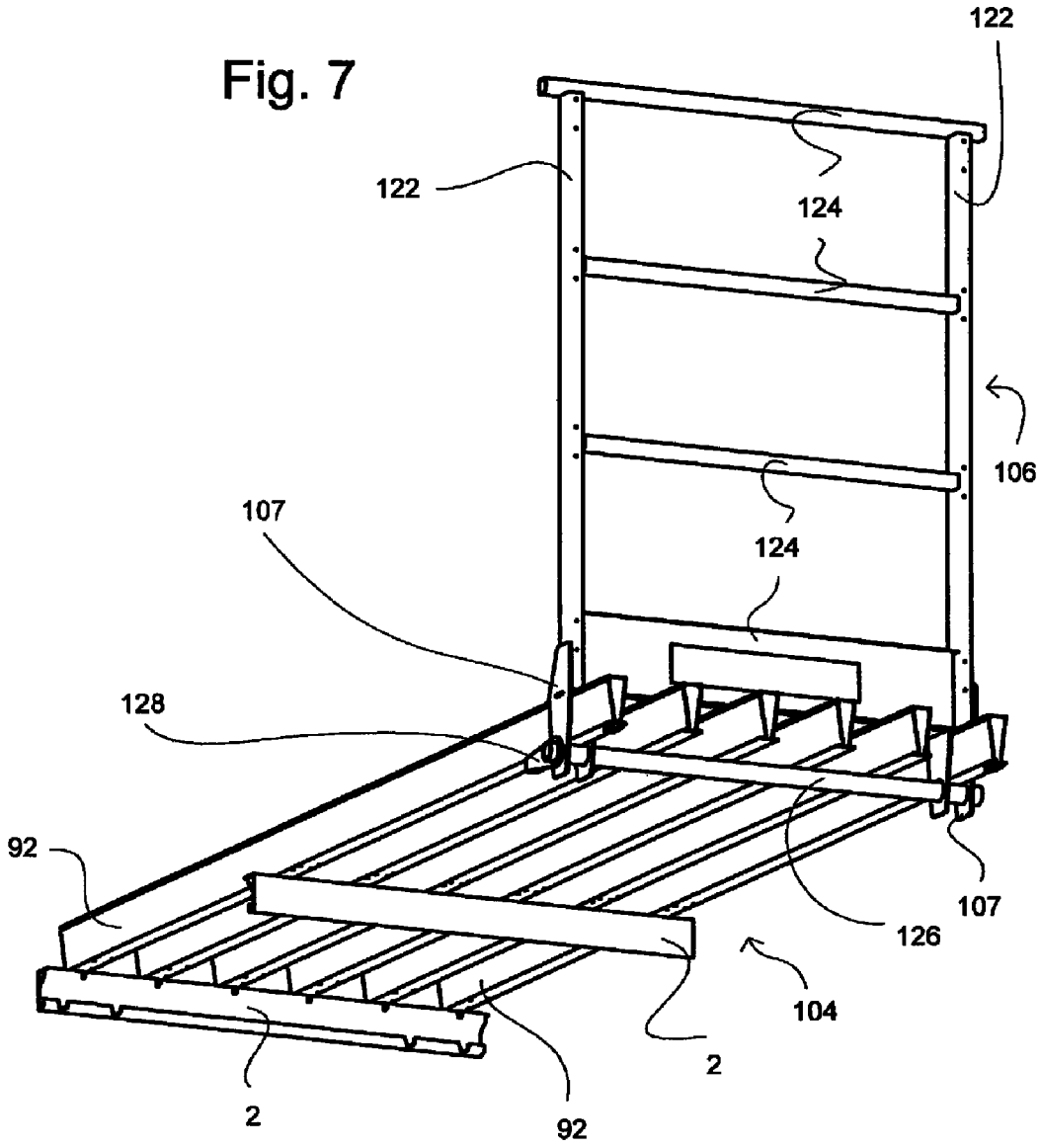
FIG. 7 is a three-dimensional view of a formwork element with a railing member coupled thereto.

FIG. 7 shows, in a three-dimensional representation, the manner in which, prior to the pivoting of a formwork element 104, it can be coupled to a railing member 106. The formwork element 104 in accordance with FIG. 7 has a cross member 2 in its end-face end region of its longitudinal members 92. A further cross member 2 supports the longitudinal members 92 in their central region, whereas the other end-face end of the longitudinal members 92 is made free of a cross member.

The railing member 106 coupled with the formwork element 104 consists of two vertical sections 122 which extend parallel to one another and which are connected to one another by a total of four horizontal sections 124, with these horizontal sections 124 being spaced apart approximately equidistantly. As railing spars, the horizontal sections 124 in this process form the security against falling required in accordance with the invention.

At the lower end of the vertical sections 122 facing the formwork element 104, a respective fastening section 107 is formed via which the railing member 106 can be coupled to the two outermost longitudinal members 92 of the formwork element 104.

The fastening sections 107 each engage around a longitudinal member 92 from above in the manner of a clamp and project at their two limbs downwardly beyond the lower side of the respective longitudinal member 92. In this projecting region of the limbs, the fastening sections 107 each have a circular opening in each of the two downwardly extending limbs, with a tangent to these openings coinciding with the lower side of the longitudinal member 92.

A latching bar 126 is inserted through the named openings of the fastening sections 107 and its length corresponds approximately to the length of a cross member 2 of the formwork element 104. The latching bar 126 does not have a circular cross-section. The cross-section can, for example, be oval or substantially circular with a flattened side. What is essential is that the cross-section of the latching bar 126 is larger in one direction than in a direction extending perpendicular thereto.

A lever 128 is arranged at an end-face end of the latching bar 126 and the latching bar 126 held in the fastening sections 107 can be rotated around its longitudinal axis by means of it.

On the coupling of a railing member 106 with a formwork element 104, the latching bar 126 is oriented such that its lower cross-sectional dimension is oriented parallel to the vertical sections 122. In this position, the fastening sections 107 can be threaded via the end-face ends of the longitudinal members 92. After the railing member 106 has been brought to the desired position along the longitudinal member 92, the latching bar 126 is rotated by 90° via the lever 128 such that then its larger cross-sectional dimension extends parallel to the vertical sections 122. In this position, the longitudinal members 92 engaged around by the fastening sections 107 are clamped between the lower end-face end of the respective vertical section 122 and the latching bar 126 such that a relative movement is no longer possible between the railing member 106 and the formwork element 104. In this rigidly coupled position, the formwork element 104 can be pivoted upwardly in the manner described in connection with FIG. 5 together with the railing member 106.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A slab formwork system, comprising:

a plurality of formwork elements which have first hook members at their lower side; and vertical supports having second hook members at upper end sections thereof for establishing a hook connection with first hook members, with the first and second hook members being designed such that the hook connection can be established when the formwork element and the vertical supports extend parallel or obliquely to one another and such that a pivoting of the formwork element is made possible while maintaining the hook connection, into such a position in which the formwork element and the vertical supports include an angle of approximately 90°, wherein the second hook members form the very ends of the upper end sections, wherein third hook members are hung into the formwork elements, the third hook members being coupled to tensioning members, wherein hook connections are effective between the third hook members and the formwork elements when the formwork elements and vertical supports extend parallel or obliquely to one another, when the formwork element and vertical supports include an angle of approximately 90°, and when the formwork element is pivoted between the aforesaid positions.

2. A slab formwork system in accordance with claim 1, wherein the formwork elements comprise a plurality of longitudinal members extending parallel to one another and at least one cross member extending transversely thereto, with the first hook members being provided at the cross member or being formed by the cross member.

3. A slab formwork system in accordance with claim 2, wherein the cross members have an at least regionally C-shaped cross-section with two limbs extending away from a base section, with one of the limbs being designed as a support surface for placing on an upper end section of a vertical support, which in turn has fixing elements in each case engaging into a recess of the support surface.

4. A slab formwork system in accordance with claim 3, wherein third hook members engage behind the limb forming the support surface.

5. A slab formwork system in accordance with claim 2, wherein the railing member consists of at least one cross-spar and two supports extending perpendicular thereto which have a respective fastening section at each of their ends remote from the cross-spar for coupling to a respective longitudinal member of a formwork element.

6. A slab formwork system in accordance with claim 5, wherein the fastening sections each engage around a longitudinal member at all sides.

7. A slab formwork system in accordance with claim 5, wherein the two fastening sections of a railing member are connected to one another by a latching bar which, in its latched position coupled to a formwork element, supports those longitudinal members which are arranged between the longitudinal members coupled to the fastening sections.

8. A slab formwork system in accordance with claim 2, wherein the longitudinal members and cross members of the formwork elements are rigidly connected to one another, with standard formwork elements having two cross members provided in the end regions of the longitudinal members remote from one another, whereas transverse compensation formwork elements have one or two cross members arranged offset inwardly in comparison with the standard formwork elements.

9. A slab formwork system in accordance with claim 1, wherein the third hook members have a force transmission region whose cross-section is made at least substantially circular or partly circular.

10. A slab formwork system in accordance with claim 9, wherein the center of the cross-section of the force transmission region has a spacing from the pivot axis of the formwork element of less than 2 cm.

11. A slab formwork system in accordance with claim 1, wherein the third hook members have an eyelet for fastening to a chain.

12. A slab formwork system in accordance with claim 1, wherein the tensioning member is a chain.

13. A slab formwork system in accordance with claim 1, wherein the plurality of formwork elements include a formwork side that is separated from the lower side, and wherein the very ends of the upper end sections of the vertical supports form the hook connection at the support sides of the formwork elements.

14. A slab framework system in accordance with claim 1, wherein the formwork element can be coupled, prior to the pivoting, with a railing member extending substantially perpendicular to the formwork element.

15. A slab framework system in accordance with claim 1, wherein the third hook members each comprise a lug region having an eyelet, wherein a coupled tensioning member applies a tensioning force to the eyelet in both the aforesaid positions.

16. A slab framework system in accordance with claim 15, wherein the third hook members each comprise a U-shaped member connected to the lug region.

17. A slab framework system in accordance with claim 16, wherein the U-shaped member is coupled to a portion of a connected tensioning member within a force transmission region.

18. A slab framework system in accordance with claim 17, wherein the U-shaped member directly applies the tensioning force from the connected tensioning member to the force transmission region of the coupled vertical support in both the aforesaid positions.

19. A method in accordance with claim 1, further comprising:

anchoring a free end of the tensioning member such that tension is applied from the tensioning member to the third hook member coupled to the formwork element before and after pivoting the formwork element into that position in which the formwork element and the vertical supports include an angle of approximately 90°, wherein the tensioned third hook member maintains the hooked coupling between the first and second hook members before and after pivoting the formwork element into that position in which the formwork element and the vertical supports include an angle of approximately 90°.

20. A method for the preparation of a slab formwork system having a plurality of formwork elements, comprising:

hooking first hook members located at a lower side of a formwork element together with second hook members provided at upper end sections of vertical supports, wherein the formwork element and the vertical supports extend one of parallel and obliquely to one another upon being hooked together;

enabling pivoting of the formwork element into such a position in which the formwork element and the vertical supports include an angle of approximately 90°, while maintaining the hook connection; and coupling at least one third hook member to a tensioning member hung into the formwork elements before a pivoting of the formwork element into that position in which the formwork element and the vertical supports include an angle of approximately 90°, wherein the second hook members form the very ends of the upper end sections.

21. A method in accordance with claim 20, wherein during the pivoting of the formwork element and on the end of the pivoting movement, the third hook member is pivoted to said formwork element.

22. A method in accordance with claim 21, wherein the spacing of the center of the cross-section of a force transmission region of the third hook member from the fastening point on a base side of a tensioning member coupled to the third hook member varies by a maximum of 10 mm during the pivoting of the formwork element.

23. A method in accordance with claim 20, wherein the first hook members each comprise an upwardly angled lug with a plurality of vertically arranged V-shaped cut-outs, each V-shaped cut-out merging into a horizontally arranged recess in the lug.

24. A method in accordance with claim 23, wherein each second hook member comprises a central U-shaped section protruding from the end of a respective upper end section and a plurality of protruding fixing lugs arranged about the U-shaped section, and wherein, the upwardly angled lug engages with the fixing lugs as guided by the V-shaped cut-outs, the upwardly angled lug being moved into the horizontally arranged recesses during the pivoting of the formwork element into a horizontal position.

25. A method in accordance with claim 23, wherein the engagement between the upwardly angled lug and the fixing lugs prevents longitudinal movement of a respective formwork element and vertical support.

26. A method in accordance with claim 20, wherein the plurality of formwork elements include a formwork side that is separated from the lower side, and wherein the very ends of the upper end sections of the vertical supports form the hook connection at the support sides of the formwork elements.

27. A method in accordance with claim 20, further comprising:

coupling the formwork element, prior to the pivoting, with a railing member extending substantially perpendicular to the formwork element.

28. A method in accordance with claim 20, wherein the tensioning member comprises a chain.

29. A method in accordance with claim 28, wherein the tensioning member is hung into a cross member of the formwork elements.

30. A slab formwork system, comprising:

a plurality of formwork elements which have first hook members at their lower sides; and vertical supports having second hook members at upper end sections thereof for establishing a hook connection with first hook members, with the first and second hook members being designed such that the hook connection can be established when the formwork elements and the vertical supports extend parallel or obliquely to one another and such that a pivoting of the formwork elements is made possible while maintaining the hook connection, into such a position in which the formwork elements and the vertical supports include an angle of approximately 90'; and wherein the formwork elements can be coupled, prior to the pivoting, with a railing member extending substantially perpendicular to the formwork elements, wherein the first hook members each comprise an upwardly angled lug with a plurality of vertically arranged V-shaped cut-outs, each V-shaped cut-out merging into a horizontally arranged recess in the lug.

31. A slab formwork system in accordance with claim 30, wherein each second hook member comprises a central U-shaped section protruding from the end of a respective upper end section and a plurality of protruding fixing lugs arranged about the U-shaped section, and wherein, the upwardly angled lug engages with the fixing lugs as guided by the V-shaped cut-outs, the upwardly angled lug being moved into the horizontally arranged recesses during the pivoting of the formwork element into a horizontal position.

32. A slab formwork system in accordance with claim 31, wherein the engagement between the upwardly angled lug and the fixing lugs prevents longitudinal movement of a respective formwork element and vertical support.

* * * * *